US005794689A

United States Patent [19]

Ghiani

[11] Patent Number: 5,794,689

[45] Date of Patent: Aug. 18, 1998

[54] RADIATOR FOR A MOTOR VEHICLE

[75] Inventor: Franco Ghiani, Bietigheim-Bissingen, Germany

[73] Assignee: BEHR GmbH & Co., Stuttgart, Germany

[21] Appl. No.: 614,841

[22] Filed: Mar. 8, 1996

[30] Foreign Application Priority Data

Mar. 10, 1995 [DE] Germany ..... 195 08 570.1

[51] Int. Cl.[6] ..... F28D 7/00

[52] U.S. Cl. ..... 165/140; 165/173; 165/916

[58] Field of Search ..... 165/140, 916, 165/173; 123/41.33

[56] References Cited

U.S. PATENT DOCUMENTS

| | | | |
|---|---|---|---|
| 1,953,927 | 4/1934 | Chase | 165/140 |
| 1,976,086 | 10/1934 | Otwell | 165/140 X |
| 3,116,541 | 1/1964 | Nickol et al. | 165/140 |
| 3,265,126 | 8/1966 | Donaldson | 165/140 |
| 4,227,570 | 10/1980 | Crews | 165/140 X |
| 4,448,242 | 5/1984 | Andres et al. | 165/140 X |
| 4,903,760 | 2/1990 | Joshi et al. | 165/140 X |
| 5,067,561 | 11/1991 | Joshi et al. . | |

FOREIGN PATENT DOCUMENTS

| | | |
|---|---|---|
| 3308349 | 9/1984 | Germany . |
| 4320342 | 12/1994 | Germany . |
| 94 20659 | 3/1995 | Germany . |
| 159513 | 3/1982 | Japan . |
| 59945 | 7/1993 | Japan . |

*Primary Examiner*—Leonard R. Leo
*Attorney, Agent, or Firm*—Foley & Lardner

[57] ABSTRACT

A radiator has at least one radiator tank containing an integrated heat exchanger. The heat exchanger and the radiator tank each have inlet and outlet fluid communication connectors. The heat exchanger and the radiator tank, including the connectors are integrally as a single-piece, of a same material. This simplifies manufacture and improves durability. Because the radiator tank and the integrated heat exchanger are made of just a single type of material, recycling is made simpler.

25 Claims, 3 Drawing Sheets

RADIATOR FOR A MOTOR VEHICLE

BACKGROUND OF THE INVENTION

The present invention relates to a radiator, in articular for a motor vehicle, with at least one radiator tank having a heat exchanger integral therewith.

As vehicle radiators are mass-produced, an economical way of manufacturing them is desirable. When the vehicle, however, is scrapped, the radiators should have the capability of being easily disposed of or recycled. In known vehicle radiators, recycling is not assured, at least not without difficulty. Above all else, because they are made of different materials, separation or at least economical separation is not possible much of the time. Because prior radiators employ different materials, on the one hand in the production of the radiator and on the other in the production of the heat exchanger integrated there into, high manufacturing costs are incurred, for example solely because of the necessary seals and the special embodiments at the fluid communication connecting points. Besides the higher manufacturing costs, higher administrative costs also arise as a result of the large number of parts. High manufacturing costs also arise for the connection or realization of the individual lines because of the necessary seals, screw connections, and the like. It is customary to use not only aluminum for these radiators, but also plastic, rubber, and nonferrous metals, particularly copper. It is precisely this that makes disposal by material types difficult.

SUMMARY OF THE INVENTION

Accordingly, the object of the invention is to improve the aforementioned radiator type at the outset so that both the manufacturing costs and the costs for scrapping or recycling can be reduced. This object is attained according to the invention by integrating a radiator tank holding a heat exchanger into an integral single-piece (unitary) common housing, which preferably can be formed from plastic and castable metal. In particular, according to the present invention the radiator, particularly for a motor vehicle, comprises at least one radiator tank containing the heat exchanger. The heat exchanger and the radiator tank each have at least one discrete fluid communication connector. In particular, both the heat exchanger and the radiator tank each have discrete inlet and outlet fluid communication connectors. The heat exchanger and the radiator tank are integral as a unitary piece thus being homogeneouly integral of a same material. Preferably, the connectors are also integral with the radiator tank, which preferably is diecasted or injection molded.

According to the present invention, the radiator preferably includes a tube bottom for holding cooling tubes integrally formed with the radiator. The tube bottom includes stepped recesses forming inserting stops for the cooling tubes. The cooling tubes have chamfered recesses on the outer surface or have narrowed configuration to aid insertion of the cooling tubes into the tube bottom.

The radiator tank has openings closed by covers, which is plated with a solder, which covers can be soldered on to the opening in a soldering furnace. The heat exchanger inlet and outlet connectors are preferably disposed on one side of the radiator tank and at least one first closable core removal opening is disposed on the opposite side of the radiator tank. A second core removal opening is formed on the one side of the radiator tank, at the transition of at least one of the heat exchanger inlet and outlet connectors into the radiator tank.

The first core removal opening preferably extends substantially parallel to the plane of the radiator, and the second core removal opening extends perpendicularly to the first core removal opening. Ribs are formed integral and unitary with the heat exchanger.

BRIEF DESCRIPTION OF THE DRAWINGS

These and other features, aspects, and advantages of the present invention will become much more apparent from the following description, appended claims, and accompanying drawings, which illustrate a preferred exemplary embodiment.

DETAILED DESCRIPTION OF THE PREFERRED EMBODIMENTS

Although references are made below to directions, such as left, right, upper, lower, etc., in describing the structure, they are made relative to the drawings (as normally viewed) for convenience of description. Accordingly, the directions are not intended to be taken literally or limit the present invention in any form.

Figure 5:
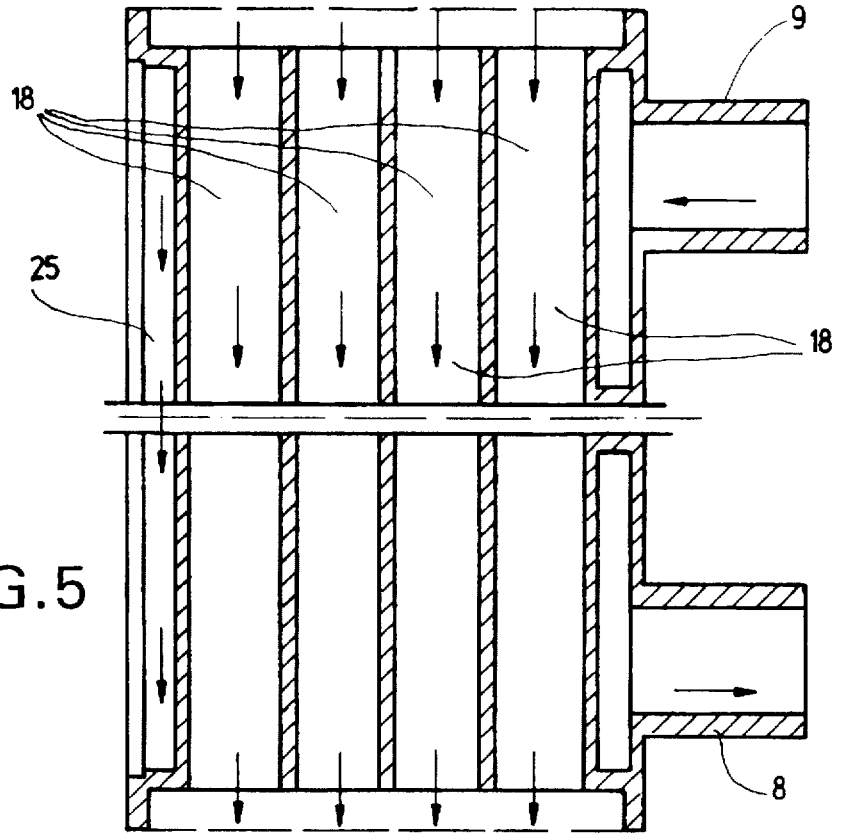
FIG. 5 is a cross-sectional view taken along the line V—V of FIG. 2.
Figure 6:
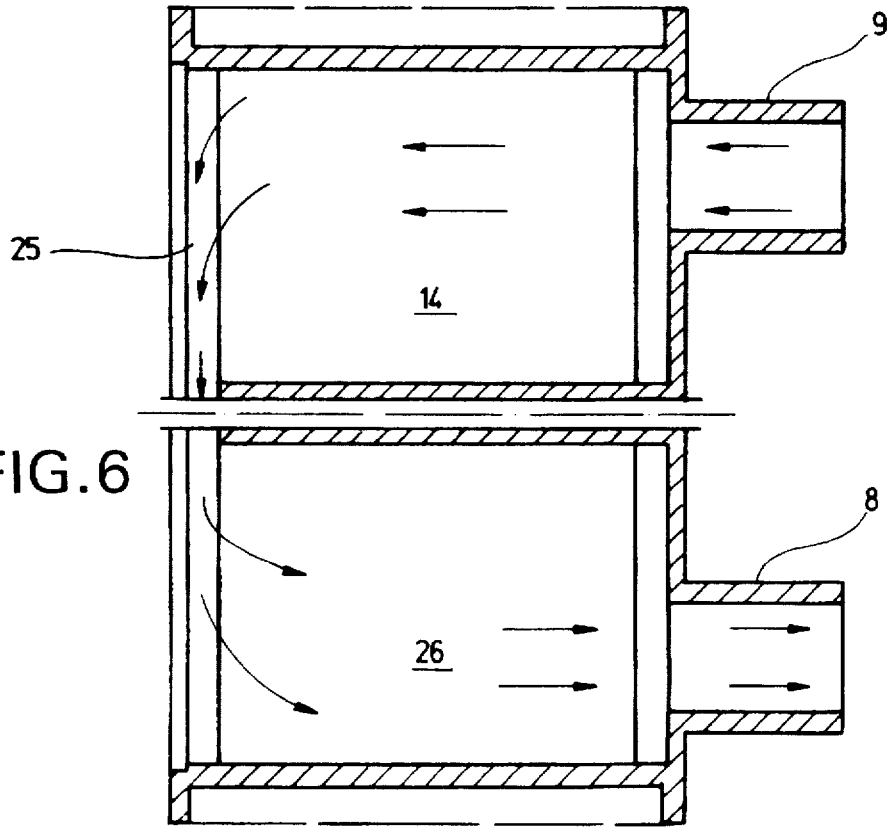
FIG. 6 is a cross-sectional view taken along the line VI—VI of FIG. 2.

In the exemplary embodiment, the radiator 1 has an upper radiator tank 2 and a lower radiator tank (not shown). Water cooling tubes 3 extend between the upper and lower tanks, through which, for example, cooling water for the engine flows when used in a motor vehicle. A receiver 4, which is circular in the exemplary embodiment, is used for mounting a ventilator, such as a fan, which transports cooling air along the outside of the tubes 3 transversely to the radiator 1. On the inside of at least the upper radiator tank 2, an integrated heat exchanger 5 is disposed, which exchanger, for example, can be an oil cooler used for cooling a motor oil. The radiator fluid flows in via one of the fluid communication ports or connectors 6 and 7 of the upper radiator tank 2 and out again via at least one connector of the lower radiator tank, or vice versa. Other fluid communication ports or connectors 8 and 9 make possible the inflow or outflow of the medium or oil to be cooled in the integrated heat exchanger 5 (or oil cooler for example). According to FIGS. 5 and 6, the oil flows in, for example via the connector 9 and out via the connector 8 after flowing through the heat exchanger 5 in an appropriate manner. The arrows drawn in these drawing figures indicate the flow-through direction.

According to the present invention, the radiator tank housing 10 is formed integrally with the heat exchanger housing 11, defining a single-piece common housing 12, for example, a one-piece metal cast housing. Preferably, the connectors 8 and 9 or 6 and 7 are also formed integrally with the common housing 12. The medium or oil to be cooled, which flows in via the connector 9 (FIG. 2), for example in accordance with the arrow 13, flows via parallel conduits 14 and 15 to a collecting conduit provided on the back side, and from there via parallel conduits 26 and 27 to the connector 8. The cooling medium or cooling water flows through the hydraulically interconnected hollow chambers 16 and 17 of the radiator tank 2. Furthermore, the cooling water also flows through conduits 18, which are disposed between the conduits 14, 15 and 26, 27 of the heat exchanger 5. This flow-through is also indicated by arrows in FIG. 5.

In the exemplary embodiment, the common housing 12 or radiator tank 2 is advantageously integrally formed in one-piece with a tube bottom 19. The tube bottom has a number of tube recesses 20, which correspond to the number of the cooling tubes 3, and the cross sectional shape of the recesses corresponds to the exterior cross section of the tubes 3. Normally, these cooling tubes are oval or flat, whose long sides are formed by essentially parallel tube walls. In the exemplary embodiment according to FIG. 2, only the cooling tubes 3 are provided, disposed one behind the other, extending over the entire width of the radiator tank 2. Alternatively, smaller tubes can also be used so that two or three layers are disposed next to one another.

The tube recesses 20 (see FIG. 2) are offset in step fashion at least in the region of the tip ends of the tubes 3 so that the free edges of the respective tube ends each can be supported on a step 21. These steps 21 constitute inserting stops so that the tubes 3 can be slid into the tube recesses 20 until they strike the steps 21. The connection is carried out in a known manner, particularly by soldering. The mouth of the tube recesses 20 can be slightly enlarged, chamfered, or beveled so that the ends of the tubes 3 can be more rapidly and reliably slid in.

Figure 1:
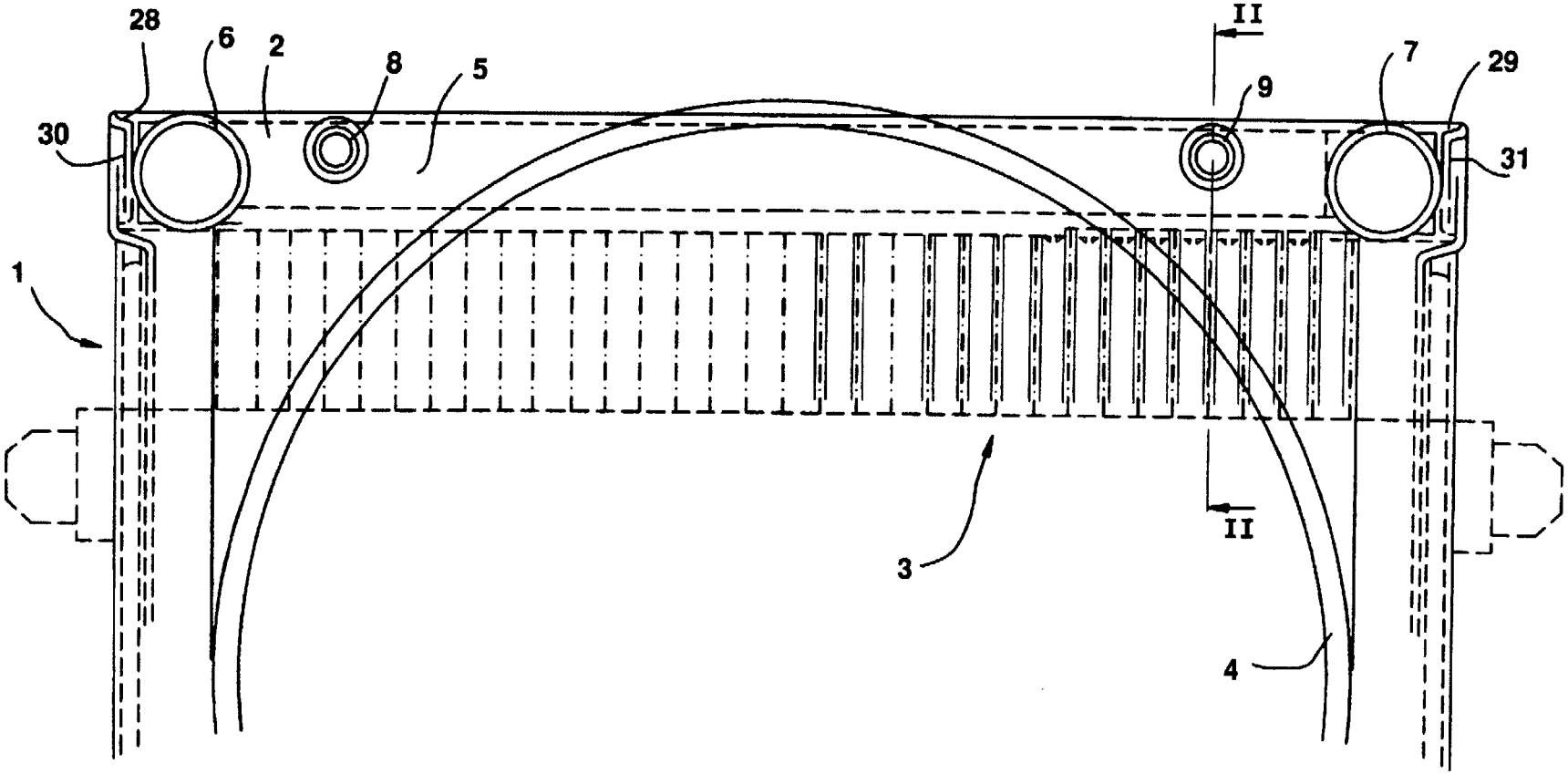
FIG. 1 is a front view of the radiator according to the present invention with its radiator tank and the integrated heat exchanger.

With reference to FIG. 1, each radiator tank has front and rear closable openings 28 and 29, which can be closed by means of covers 30 and 31. The cover 30 or 31 can be soldered on in a suitable manner. These openings 28 and 29 are for a simple diecasting manufacture. A rod can be introduced and withdrawn via each of the openings 28 and 29 or they can be used for core removal.

Figure 2:
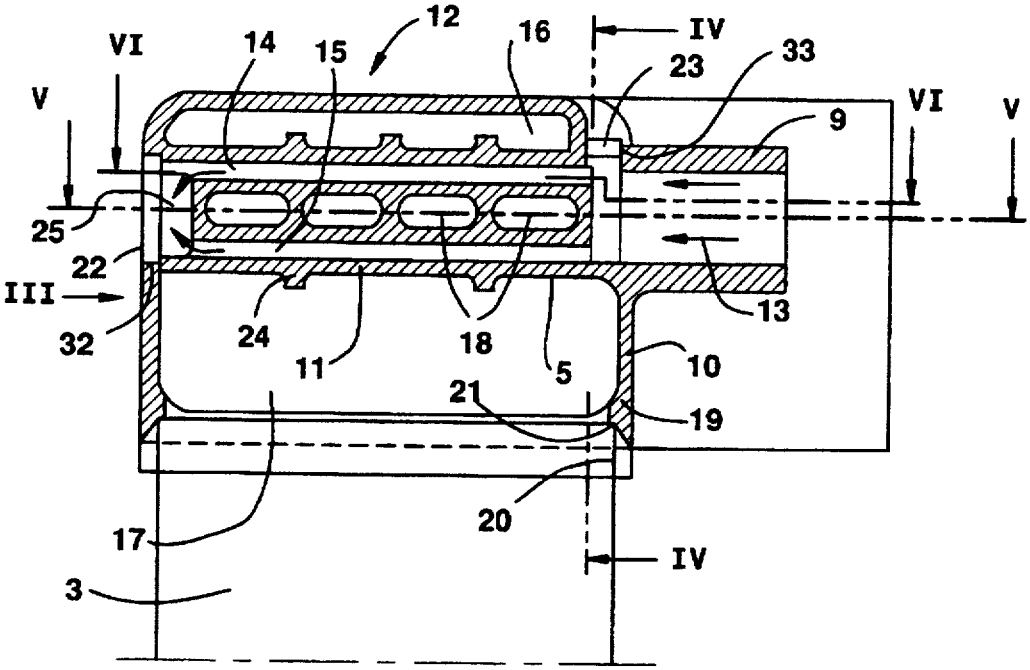
FIG. 2 is an enlarge cross-sectional view of taken along the line II—II through the radiator tank of FIG. 1.
Figure 3:
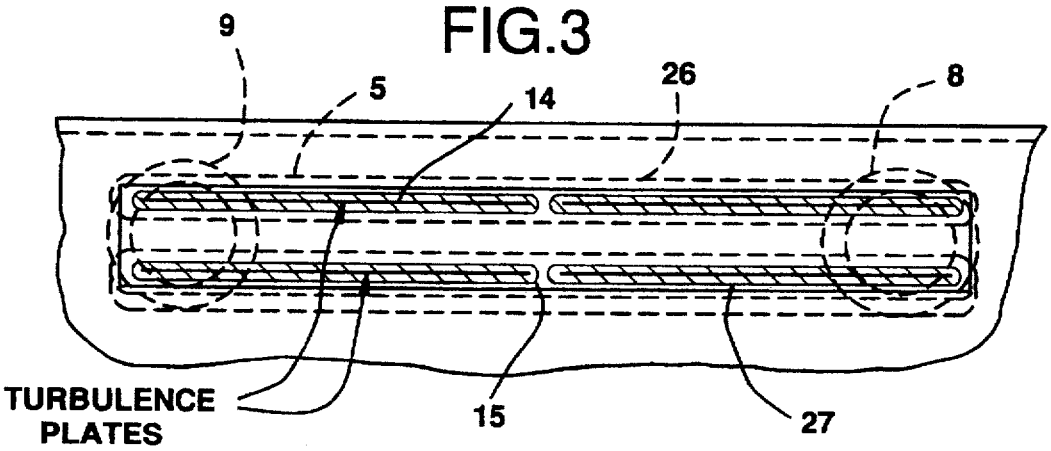
FIG. 3 is a side view taken along the arrow III of FIG. 2.

If the right side of FIG. 2 is viewed as the front side of the common housing, then the two connectors 8 and 9 are disposed there. Correspondingly, closable core removal openings 32 are then provided on the opposite back side of the common housing 12, which openings can likewise be closed by means of a cover 22.

At least one additional core removal opening 32 is disposed at the transition of the connector 8 or 9 into the upper end of the common housing 12. It can likewise be closed by means of a cover 23, namely the cover 23 in FIG. 2. The core removal opening 33 is oriented upward in FIG. 2, while the core removal opening 32 closed by the cover 22 is oriented toward the left, that is, opens transversely therewith. The covers 22 and 23 can be plated with a solder so that they are simply inserted into the appropriate core removal opening 32 or 33, after which the solder connection is executed by means of appropriate heating.

Figure 4:
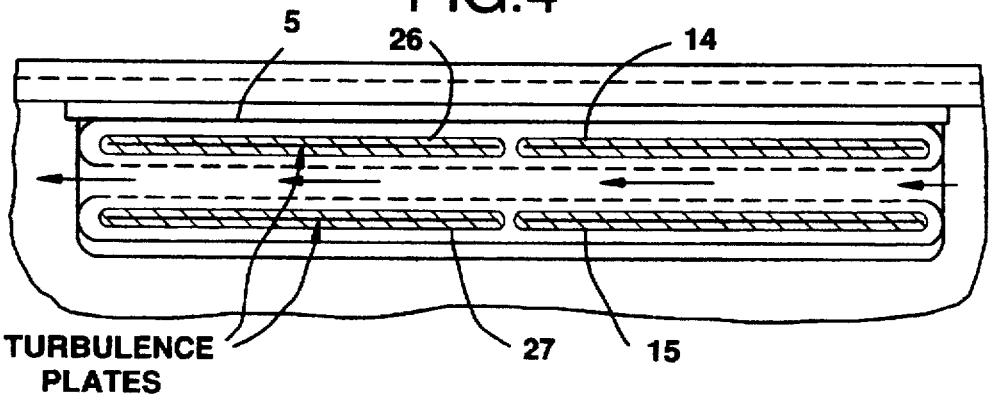
FIG. 4 is a cross-sectional view taken along the line IV—IV of FIG. 2.

It can be seen from FIG. 4 that the housing 11 of the heat exchanger 5 can be provided with ribs 24, which are the housing 11 integral with it and which protrude into the hollow chambers 16 and 17. Furthermore, turbulence plates can be provided in the conduits 14, 15 and 26, 27 as well as in the conduits 18.

Fastenings, guides, strips, or the like (not shown) can be provided for the mounting of external components, e.g. a fan cowl, baffle plates, charge-air coolers, oil coolers, and the like.

The one-piece manufacture according to the present invention cuts down on connecting points and, as a result, on corresponding assembly costs too, such as costs for seals, screw connections, and the like. On the other hand, when recycling, since only one material, the common housing 12 or the radiator tank 2, is present, disposal is easy without further effort.

The common housing can be casted or injection molded. As already mentioned, both plastic and metal, for example aluminum or corresponding light metal alloys, can be used. The one-piece manufacture of the housing of the heat exchanger and of the radiator tank also brings with it a much higher manufacturing reliability because of the reduction in the number of parts and the elimination of sealing points and connecting points. Furthermore, rubber seals in this area can be eliminated, thus increasing the operational reliability. At the same time, there is also a higher internal pressure reliability.

According to the present invention, the inlet opening and the outlet opening of the heat exchanger can be each disposed on a preformed connector. This makes possible the rapid and trouble-free connection of inlet and outlet lines. Furthermore, according to the present invention, the common housing can be manufactured of one piece with a tube bottom for tubes of the radiator. In addition, as a separate manufacture of the tube sheet, for example as a sheet metal part, which then must be sealingly fastened (such as soldered), is eliminated, both assembly costs and sealing problems are eliminated.

The tube recesses of the tube bottom can be narrowed in step fashion, at least in partial sections, to form inserting stops. This makes the assembly easier and accelerates the process. The individual tubes can be simply inserted into the recesses provided for this until they strike the step, which acts as an inserting stop. Then, the connection of the tube with the tube bottom or the common housing is carried out, in particular by soldering, which naturally presumes an appropriate material selection for the common housing.

In a suitable manner, the tube recesses can be chamfered or enlarged in an appropriate way on the outer surface to embody insertion aids for the tubes. A recess that tapers conically inward is also wholly conceivable, but only when the plug-in depth is relatively shallow.

A preferred embodiment of the invention is comprised in that the radiator tank has openings on its face end that can each be closed by a cover. In a diecasting tool or in the diecasting manufacture of the common housing, these openings can be used for the introduction and removal of the rod or core. The covers can be plated with solder in order to be able to fasten them in the soldering furnace.

The connectors of the heat exchanger can be disposed on the front side of the common housing and at least one closable core removal opening can be disposed on the opposite side, on the back side of the common housing. As a result, the radiator according to the present invention, on the whole, is advantageous not only in manufacturing standpoint, but also for the later flowthrough.

In diecasting manufacture, it can furthermore be advantageous if at least one additional core removal opening is provided on the front side of the common housing, particularly at the transition of the connector into the housing. All core removal openings can be closed in a preferred manner by means of covers, which can be soldered on when the common housing is made of metal, and can be, for example, glued or welded on when the common housing is made of plastic. In the former case, the covers are plated with solder in a very advantageous way and can be soldered on in the soldering furnace.

According to another aspect of the present invention, the heat exchanger is provided with ribs, which are formed onto it and of one piece with it, wherein in the case of casting manufacture, they are preferably external ribs.

During the casting manufacture, appropriate recesses, guides, and the like can be provided for turbulence plates or the like and eyes, fastening means, and/or connecting means can be provided on the outside, integrally with it as a one-piece. A fastening means for fastening the radiator at the position provided in the motor vehicle and for mounting auxiliary units or expansion radiators for instance can be provided.

Given the disclosure of the present invention, one versed in the art would readily appreciate the fact that there may be other embodiments and modifications well within the scope and spirit of the present invention. Accordingly, all expedient modifications readily attainable by one versed in the art from the present disclosure within the scope and spirit of the present invention are to be included as further embodiments of the present invention. The scope of the present invention accordingly is to be defined as set forth in the appended claims.

I claim:

1. A radiator, particularly for a motor vehicle, comprising:

at least one radiator tank having a chamber with two opposing sides; and a heat exchanger disposed within the radiator tank, in the radiator-tank chamber, the heat exchanger having a pair of spaced-apart walls forming at least one fluid communication path between the walls, and the spaced-apart walls connecting the chamber sides, wherein the heat exchanger and the radiator tank each have at least one fluid communication connector extending from one of the chamber sides, wherein the spaced-apart walls of the heat exchanger are exposed to the radiator-tank chamber.

2. The radiator according to claim 1, wherein the heat exchanger and the radiator tank are integrally diecasted or injection molded.

3. The radiator according to claim 1, wherein the heat exchanger has two fluid communication connectors, one being an inlet and the other being an outlet, wherein the inlet and outlet connectors are integrally formed with the radiator tank.

4. The radiator according to claim 3, wherein the heat exchanger inlet and outlet connectors are disposed on a common chamber side of the radiator tank, and wherein the radiator tank includes at least one first closable core removal opening disposed on another side opposite the common chamber side of the radiator tank.

5. The radiator according to claim 4, wherein the radiator tank includes a second core removal opening formed on the common chamber side of the radiator tank, at a transition of at least one of the heat exchanger inlet and outlet connectors, into the radiator tank.

6. The radiator according to claim 5, wherein the first core removal opening extends substantially parallel to a plane of the radiator, and the second core removal opening extends perpendicularly to the first core removal opening.

7. The radiator according to claim 1, wherein the radiator tank includes an integral tube bottom for holding cooling tubes.

8. The radiator according to claim 7, wherein the tube bottom includes stepped recesses forming inserting stops for limiting insertion of the cooling tubes.

9. The radiator according to claim 8, wherein the recesses each have a chamfer or taper to facilitate insertion of the cooling tubes.

10. The radiator according to claim 1, wherein the radiator tank has openings.

11. The radiator according to claim 10, wherein the radiator tank includes covers plated with a solder, the covers being soldered on to the openings in a soldering furnace.

12. The radiator according to claim 1, further comprising ribs integral and unitary with the heat exchanger.

13. The radiator according to claim 1, wherein the radiator tank and the heat exchanger each have fluid conduits, and wherein turbulence plates are positioned in the conduits of the radiator tank and the heat exchanger.

14. The radiator according to claim 1, further comprising like fastening or connection means integral with the radiator tank for fastening a fan cowl, baffle plates, charge-air coolers, or oil coolers, to the radiator.

15. A radiator, particularly for a motor vehicle, comprising:

at least one radiator tank;

a heat exchanger disposed within the radiator tank, the heat exchanger and the radiator tank each having at least one fluid communication connector, wherein the heat exchanger and the radiator tank are integral as a unitary piece formed of a same material, wherein the heat exchanger has two fluid communication connectors, one being an inlet and the other being an outlet, wherein the inlet and outlet connectors are integral with the radiator tank, and wherein the heat exchanger inlet and outlet connectors are disposed on one side of the radiator tank, and further including at least one first closable core removal opening disposed on another side opposite the one side of the radiator tank.

16. The radiator according to claim 15, wherein the radiator tank includes a second core removal opening formed on the one side of the radiator tank, at a transition of at least one of the heat exchanger inlet and outlet connectors, into the radiator tank.

17. The radiator according to claim 16, wherein the first core removal opening extends substantially parallel to a plane of the radiator, and the second core removal opening extends perpendicularly to the first core removal opening.

18. The radiator according to claim 15, further comprising ribs integral and unitary with the heat exchanger.

19. The radiator according to claim 15, wherein the radiator tank and the heat exchanger each have fluid conduits, and wherein turbulence plates are positioned in the conduits of the radiator tank and the heat exchanger.

20. The radiator according to claim 15, further comprising like fastening or connection means integral with the common housing for fastening a fan cowl, baffle plates, charge-air coolers, or oil coolers to the radiator.

21. The radiator according to claim 15, wherein the heat exchanger and the radiator tank are integrally diecasted or injection molded.

22. The radiator according to claim 15, wherein the radiator tank includes an integral tube bottom for holding cooling tubes.

23. The radiator according to claim 22, wherein the tube bottom includes stepped recesses forming inserting stops for limiting insertion of the cooling tubes.

24. The radiator according to claim 23, wherein the recesses each have a chamfer or taper to facilitate insertion of the cooling tubes.

25. The radiator according to claim 15, wherein the radiator tank has openings and covers plated with a solder, the covers being soldered on to the openings in a soldering furnace.

* * * * *